US008337254B2

(12) United States Patent
Jin

(10) Patent No.: US 8,337,254 B2
(45) Date of Patent: Dec. 25, 2012

(54) RECEPTACLE CONNECTOR AND COMPLEMENTARY PLUG

(75) Inventor: Hao Jin, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 115 days.

(21) Appl. No.: 12/883,197

(22) Filed: Sep. 16, 2010

(65) Prior Publication Data

US 2011/0111644 A1 May 12, 2011

(30) Foreign Application Priority Data

Nov. 10, 2009 (CN) ..... 2009 2 0314469

(51) Int. Cl.
*H01R 33/20* (2006.01)

(52) U.S. Cl. ..... 439/675; 439/660; 439/680

(58) Field of Classification Search ..... 439/675, 439/660, 668, 680
See application file for complete search history.

(56) References Cited

U.S. PATENT DOCUMENTS

| | | | | |
|---|---|---|---|---|
| 6,659,805 | B2 * | 12/2003 | Siddiqui et al. | 439/668 |
| 6,976,873 | B2 * | 12/2005 | Taguchi | 439/578 |
| 7,785,119 | B1 * | 8/2010 | Chiang | 439/188 |
| 7,824,228 | B1 * | 11/2010 | Yang et al. | 439/668 |
| 2006/0009082 | A1 * | 1/2006 | Lin | 439/668 |
| 2006/0166562 | A1 * | 7/2006 | Ma | 439/668 |
| 2009/0191765 | A1 * | 7/2009 | Yamada | 439/675 |

* cited by examiner

*Primary Examiner* — Hien Vu
(74) *Attorney, Agent, or Firm* — Wei Te Chung; Ming Chieh Chang

(57) ABSTRACT

An electrical connector assembly comprises an electrical receptacle and a complementary plug connector. The electrical receptacle has an insulative housing defining a first mating cavity with a circular mating post exposed therein and extending along a rear-to-front direction, and a second mating cavity in communication with the first mating cavity but located at a lateral side of periphery of the first mating cavity. A plurality of power terminals are received in the first mating cavity and a plurality of signal terminals are received in the second mating cavity. An electrical plug connector fills the first mating cavity and the second mating cavity at the same time when mated with the electrical receptacle. The electrical receptacle can not only mate with a conventional power plug connector but also mate with the present plug connector to transmit USB signals.

15 Claims, 5 Drawing Sheets

RECEPTACLE CONNECTOR AND COMPLEMENTARY PLUG

BACKGROUND OF THE INVENTION

1. Field of the Invention

The present invention relates to a receptacle connector and a complementary plug connector, and more particularly to a receptacle connector and a complementary plug connector not only providing power supply but also providing signal transmission.

2. Description of the Related Art

Power connectors are widely used in electronic products for providing power supply and commonly include a receptacle connector and a complementary plug connector. The receptacle connector usually comprises an insulative housing defining a mating cavity therein and a plurality of conductive contacts retained in the insulative housing and serving as an anode and a cathode respectively. The complementary plug connector is received in the mating cavity and engaging with the conductive contacts so as to provide power source. However, as electronic products become more and more multi-functional, there is no luxury to provide each single interface a spot in such an over-crowed peripheral, therefore, a receptacle harboring at least two interfaces, such a power source and data, is required so as to reduce the exhaustion of the peripheral, while without comprising the interfaces required from the market.

SUMMARY OF THE INVENTION

Accordingly, an object of the present invention is to provide a receptacle connector harboring at least two different interfaces.

In order to achieve the object set forth, an electrical connector assembly comprises an electrical receptacle and a complementary plug connector. The electrical receptacle has an insulative housing defining a first mating cavity with a circular mating post exposed therein and extending along a rear-to-front direction, and a second mating cavity in communication with the first mating cavity but located at a lateral side of periphery of the first mating cavity. A plurality of power terminals are received in the first mating cavity and a plurality of signal terminals are received in the second mating cavity. An electrical plug connector fills the first mating cavity and the second mating cavity at the same time when mated with the electrical receptacle.

Other objects, advantages and novel features of the invention will become more apparent from the following detailed description of the present embodiment when taken in conjunction with the accompanying drawings.

DETAILED DESCRIPTION OF THE INVENTION

Figure 1:
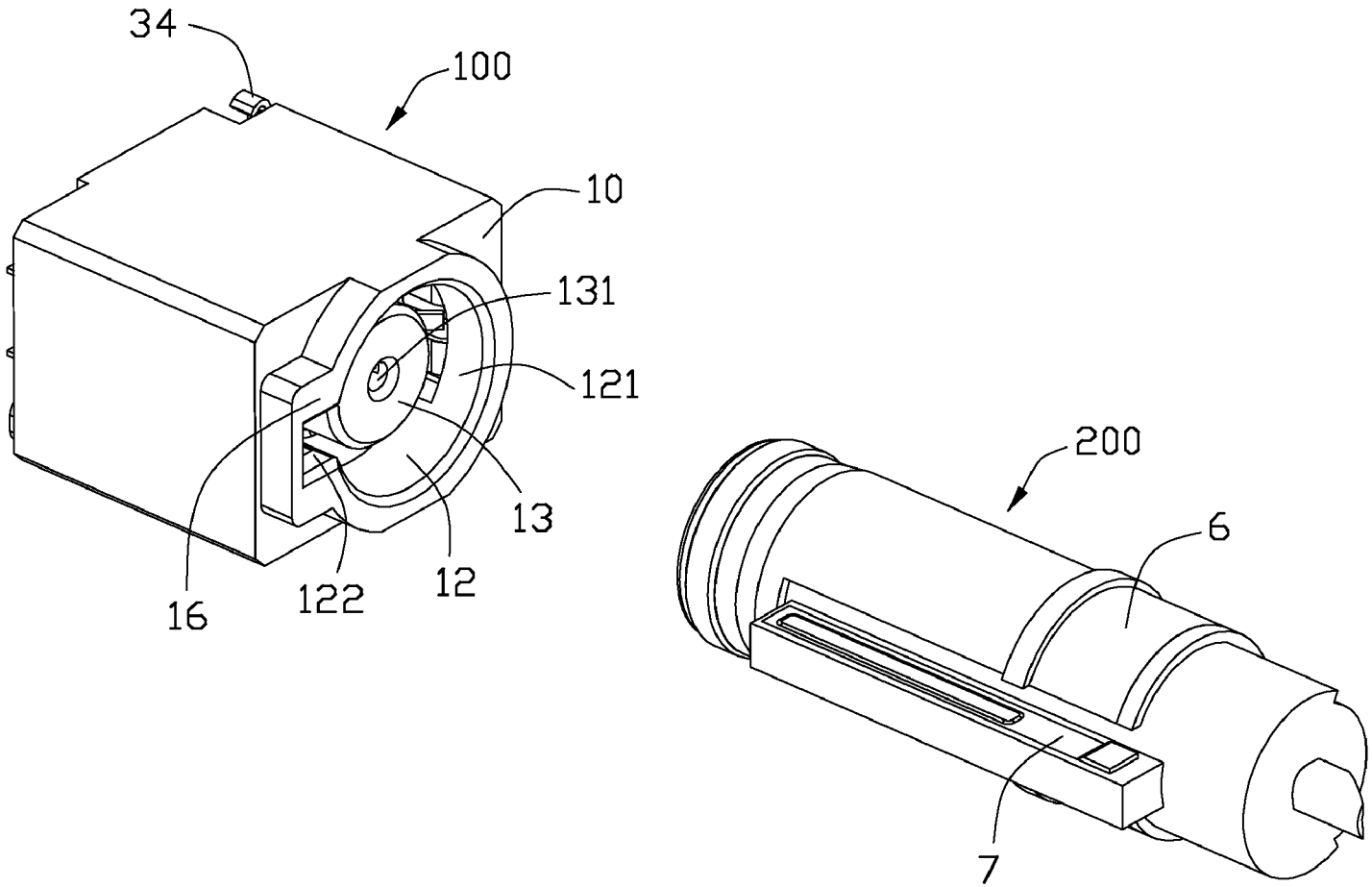
FIG. 1 is a perspective view of a receptacle connector and a complementary plug connector in accordance with the present invention.
Figure 2:
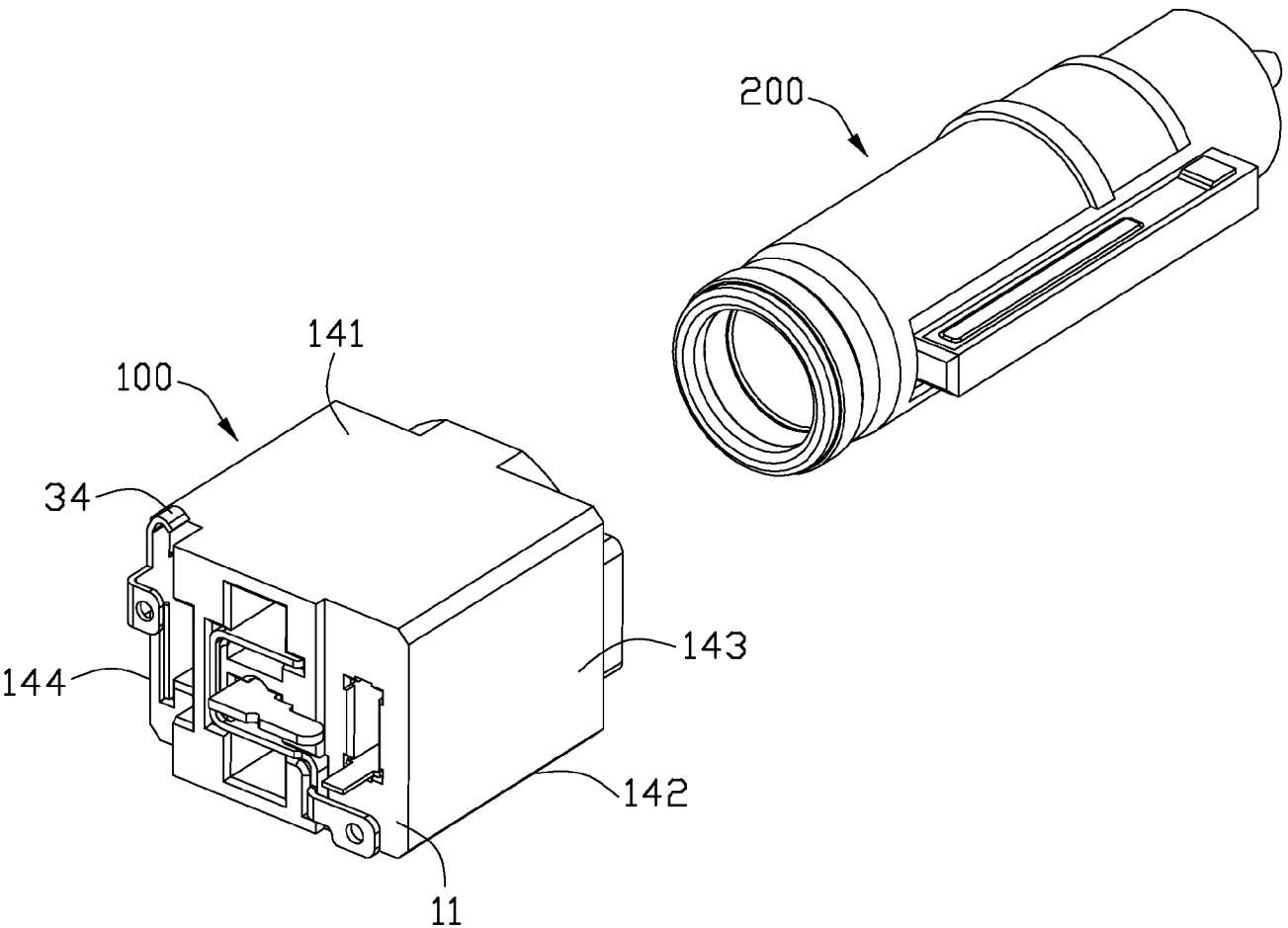
FIG. 2 is another perspective view of the receptacle connector and the complementary plug connector shown in FIG. 1.
Figure 3:
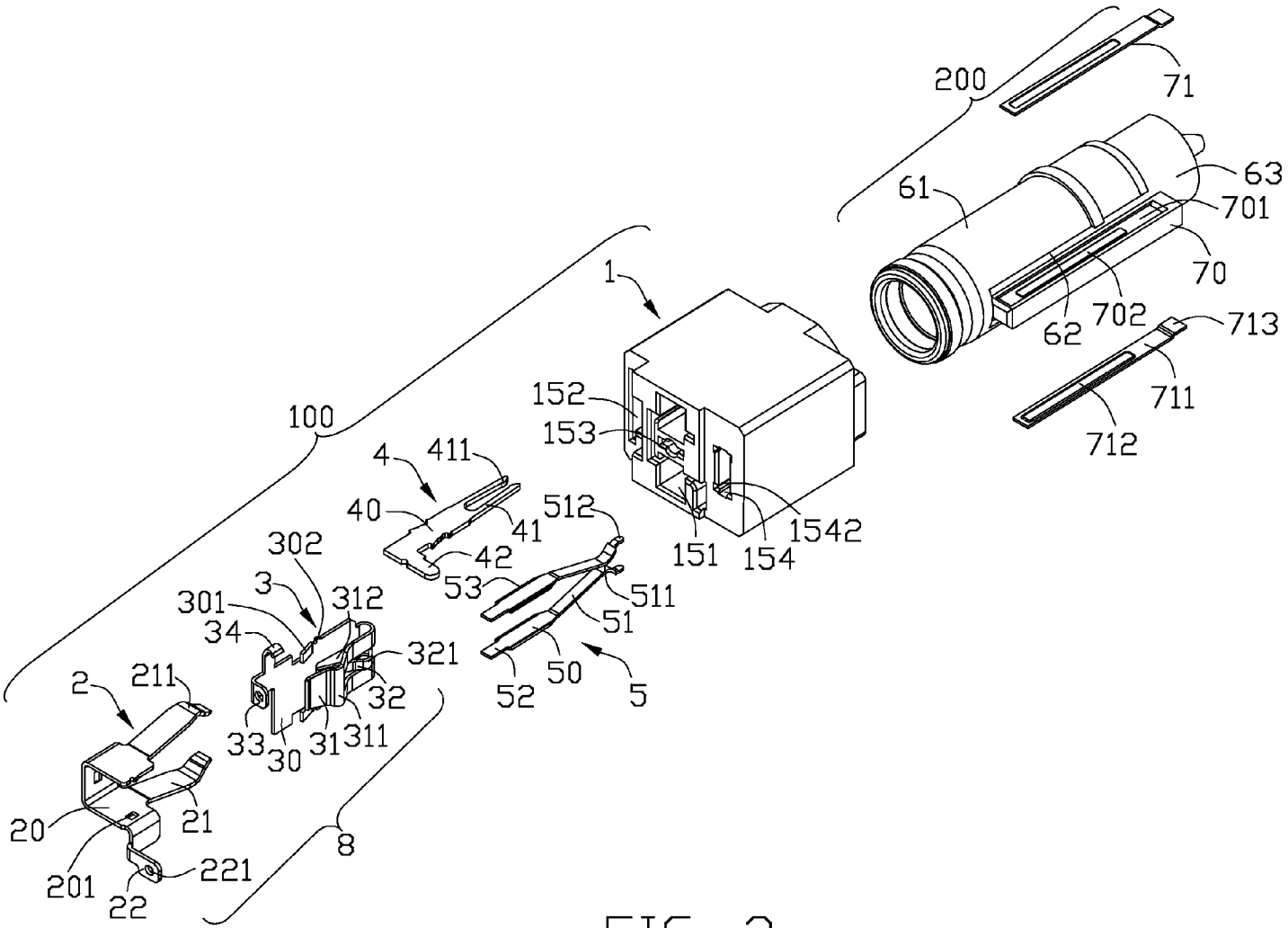
FIG. 3 is an exploded perspective view of the receptacle connector and the complementary plug connector shown in FIG. 1.

Reference will now be made to the drawing figures to describe a preferred embodiment of the present invention in detail. Referring to FIG. 1 to FIG. 3, a receptacle connector 100 and a complementary plug connector 200 according to the preferred embodiment of the present invention is provided. The receptacle connector 100 comprises an insulative housing 1 and a first terminal group 8, a second terminal group 5 and a detecting pin 4 retained in the insulative housing 1, wherein the first terminal group 8 has power terminals including a first terminal 2 for power and a second terminal 3 for ground, the second terminal group 5 includes signal terminals for transmitting signals.

The insulative housing 1 is configured as a rectangular structure and defines a front face 10 which is also designated as a mating face and a rear face 11 opposite to the front face 10. The insulative housing 1 defines an upper wall 141, a lower wall 142, a first side wall 143 and a second side wall 144 connecting said upper wall 141 and lower wall 142 thereby defining a mating cavity 12 extending rearward from the front face 10 thereof. A mating post 13 extends forward from a rear face 11 of the insulative housing 1. The mating cavity 12 comprises a circular first mating cavity 121 around the mating post 13 and a second mating cavity 122 which is defined in the first side wall 143 and extends laterally along a transverse direction. The second mating cavity 122 communicates with the first mating cavity 121 and offsets to the first mating cavity 121, to be particularly pointed out that, a central line of the first mating cavity 121 and a central line of the second mating cavity 122 are defined at a same horizontal plane. The mating post 13 defines a central slot 131 extending along a rear-to-front direction. A plurality of receiving grooves are defined in the insulative housing 1. A continuous rib 16 protrudes forward from the front face 10 around the mating cavity 12.

The first terminal 2 is inserted into a first receiving groove 151 which is defined in the insulative housing 1 and extending forward from a rear face 11 thereof. The first terminal 2 has a horizontal-U-shaped retaining portion 20, a pair of resilient arms 21 extending from opposite front edges of the retaining portion 20 toward a same direction, and a solder portion 22 perpendicularly extending from a lateral edge of the retaining portion 20 and bent outwardly. A plurality of barbs 201 are formed on the retaining portion 20 for securing the first terminal 2 in the first receiving groove 151. Each resilient arm 21 has a contacting portion 211 protruding into the first mating cavity 121. The solder portion 22 defines a hole 221 thereon and adapted to be connected with a cable or the like.

The second terminal 3 is inserted into a second receiving groove 152 which is defined in the second side wall 144 and extending forward to communicate with the first mating cavity 121. The second terminal 3 comprises a plate like retaining portion 30, a first resilient arm 31 extending reversely from a front end of the retaining portion 30 and defining an aperture 312 therein, a second resilient arm 32 extending reversely from the same front end of the retaining portion 30 and received in the aperture 312, and a solder portion 33 and a grounding portion 34 respectively extending from different edges of the retaining portion 30, wherein the grounding portion 34 exposed to an exterior of the upper wall 141 for contacting with an exterior shell or the like. The retaining portion 30 has a plurality of barbs 302 and resilient plates 301 thereon. The first resilient arm 31 defines a first contacting portion 311 located in front of a second contacting portion 321 of the second resilient arm 32 and adjacent to the front face 10.

The detecting pin 4 is inserted into a third receiving groove 153 which is defined along the central line of the mating post 13. The detecting pin 4 comprises a retaining portion 40, fork shaped contacting arms 41 extending forward from the retaining portion 40 and forming contacting portions 411 at distal end thereof, and a solder portion 42 extending from lateral side of the retaining portion 40.

Figure 5:
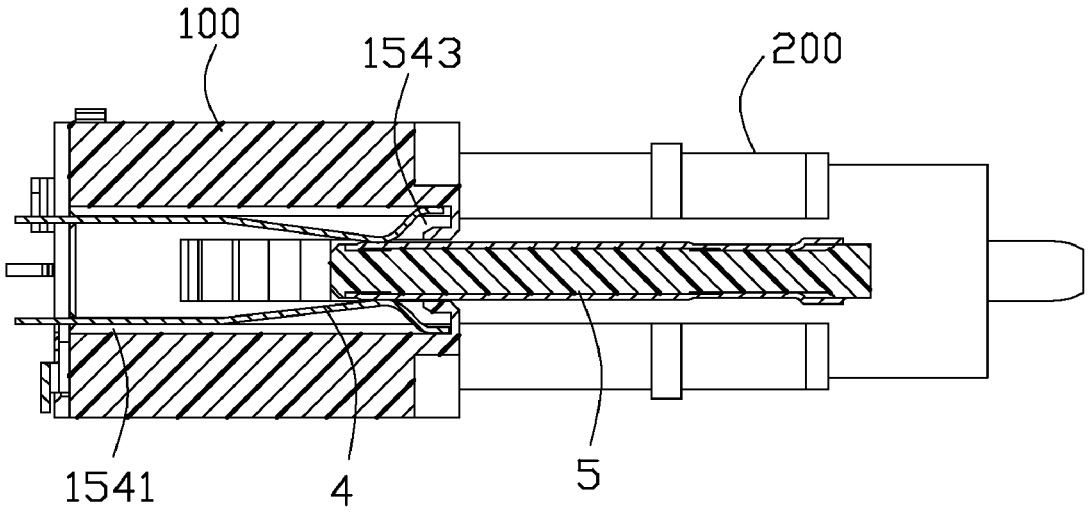
FIG. 5 is a cross-sectional view of FIG. 4 along line 5-5.

Referring to FIGS. 2, 3 and 5, the insulative housing defines a fourth receiving groove 154 communicating with the second mating cavity 142. The fourth receiving groove 154 comprises a bottom groove 1541 and a pair of retaining grooves 1542 located at opposite sides of the bottom groove 1541. The bottom groove 1541 defines a recess portion 1543 in the rib 16. The second terminal group 5 includes a pair of signal terminals each comprising a base portion 50 with a blade-shaped configuration, a resilient contacting arm 51 extending from a front end of the base portion 50, a solder portion 52 extending rearward from a rear end of the base portion 50, and retaining portions 53 extending from opposite lateral edges of the base portion 50. The contacting arm 51 is bent inwardly to be exposed in the second mating cavity 122 and forms a head portion 512 received in the recess portion 1543. The head portion 512 is narrower than the contacting arm 51 and can move upward and down within the recess portion 1543. The second terminal group 5 together with the first terminal group 8 are configured to meet the standard of the USB connector, as there are two power pins and a pair of signal pins which can transmit signals as the USB connector does, therefore, the receptacle connector 100 can be used as a multifunctional port.

The plug connector 200 comprises a first mating portion 6 received in the first mating cavity 121 and a second mating portion 7 received in the second mating cavity 122. The first mating portion 6 has a circular insulative base portion 63 and a metallic shell 61 surrounding the base portion 63. The metallic shell 61 defines an opening 62 on a periphery lateral side thereof for allowing the second mating portion 7 to pass. The second mating portion 7 comprises a rectangular shaped base portion 70 extending outwardly from the circular base portion 63 and along a front-to-rear direction. The base portion 70 defines a pair of passageways 701 at opposite sides thereof and each has a rib 702 therein and protruding outwardly. The third terminal group 71 comprises a pair of terminals having identical structures and respectively received in said passageways 701. The terminal can be attached to the passageway 701 by glue or the like. Each terminal comprises a body portion 711, a contacting portion 712 protruding outward from the body portion 711 and a solder portion 713 extending rearward from the body portion 711.

Figure 4:
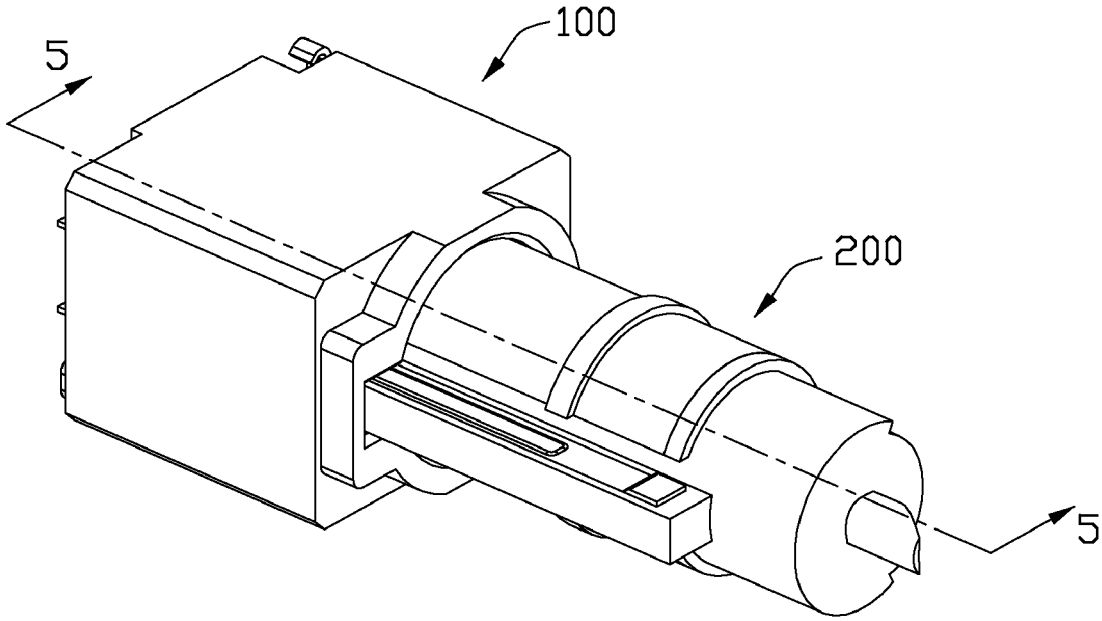
FIG. 4 is a perspective view of the receptacle connector mating with the complementary plug connector.

Referring to FIGS. 4 and 5, the receptacle connector 100 can not only mate with a conventional power plug connector for providing power supply, but also mate with the present plug connector 200 for transmitting USB signals if needed. When a conventional power plug connector is mated, it will be inserted into the first mating cavity 121 and do not contact with the third terminal group 7, therefore power supply can be accomplished. The plug connector 200 of the present invention is a non-standard USB plug connector which can transmit USB signals.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an electrical receptacle having an insulative housing defining a columnar first mating cavity with a circular mating post exposed therein and extending along a rear-to-front direction, and a rectangular second mating cavity in communication with the first mating cavity but located at a lateral side of periphery of the first mating cavity, a plurality of power terminals received in the first mating cavity and a plurality of signal terminals received in the second mating cavity; and an electrical plug connector comprising a first mating portion and a second mating portion respectively filling the first mating cavity and the second mating cavity at the same time when mated with the electrical receptacle;

wherein the first mating portion is of a columnar body and the second mating portion is of a rectangular body on a lateral side of a periphery of the columnar body in a radial direction;

wherein a metallic shell encloses the first mating portion and has an opening along a side therein for allowing the second mating portion to extend therethrough; and wherein the second mating portion defines a pair of passageways at opposite sides thereof for respectively receiving a signal terminal therein.

2. The electrical connector assembly as described in claim 1, wherein the power terminals and the signal terminals form a non-standard USB terminal group and transmit USB signals.

3. The electrical connector assembly as described in claim 2, wherein the first mating cavity is around the mating post and in a circular shape while the second mating cavity is beyond the first mating cavity and in a rectangular shape.

4. The electrical connector assembly as described in claim 1, wherein signal terminals of the electrical receptacle are located at opposite sides of the second mating cavity and contact with signal terminals of the electrical plug connector during mating.

5. The electrical connector assembly as described in claim 1, the insulative housing having a continuous rib formed on a front face thereof and surrounding the first and second mating cavities.

6. The electrical connector assembly as described in claim 1, wherein the power terminals comprise a first terminal retained in the mating post and a second terminal retained at a lateral side of the insulative housing opposite to the second mating cavity.

7. The electrical connector assembly as described in claim 1, wherein the first mating cavity and the second mating cavity both extend along the rear-to-front direction with similar distances.

8. The electrical connector assembly as described in claim 7, wherein the housing is essentially rectangular and tails of both the power terminals and the signal terminals are rearwardly exposed out of a rear face of the housing.

9. An electrical receptacle comprising:

an insulative housing defining a mating cavity therein and a mating post exposed into the mating cavity, the mating cavity being divided into two parts by an opening defined on an outmost circular of the mating cavity thereby a part within the circular forms a first columnar mating cavity and has power terminals therein which is adapted for mating with a conventional power plug connector and a part outside the circular forms a rectangular second mating cavity and has signal terminals therein to cooperate with said power terminals for mating with a non-standard plug connector;

wherein the insulative housing has a continuous rib formed on a front face thereof and surrounding the mating cavity, and distal ends of said signal terminals are received within the rib;

wherein the power terminals comprise a first terminal retained in the mating post and a second terminal retained at a lateral side of the insulative housing opposite to the second mating cavity;

wherein the housing is essentially rectangular, and tails of both the power terminals and the signal terminals are rearwardly exposed out of a rear face of the housing.

10. The electrical receptacle as described in claim 9, wherein the second mating cavity extends outwardly from the first mating cavity and said signal terminals are located at opposite sides of the second mating cavity.

11. The electrical connector assembly as claimed in claim 9, wherein both the first columnar mating cavity and the second rectangular mating cavity extend with similar distances.

12. An electrical connector for use with a complementary connector, comprising:

an insulative housing defining a columnar first mating port and a rectangular second mating port extending along an axial direction of the columnar first mating port and joined on a lateral side of a periphery of said columnar first mating port in a radial direction;

a plurality of first contacts disposed in the housing with first contacting sections at different positions with one another along an axial direction, which is perpendicular to said radial direction, in said columnar mating port; and a plurality of second contacts disposed in the housing with second contacting sections exposed on the rectangular second mating port;

wherein when the electrical connector is mated with the complementary connector, said rectangular second mating port functions as not only an orientation mating device mechanically but also an conduction transmission device electrically via the second contacting sections;

each of the columnar first mating port and the rectangular second mating port defines opposite two front and rear ends along the axial direction under condition that the front end of the rectangular second mating port is spaced rearward from the front end of the columnar first mating port with a first distance, and the rear end of the rectangular second mating port is forwardly spaced from the rear end of the columnar first mating port with a second distance, said first distance being close to the second distance;

wherein a metallic shell encloses the columnar first mating port and has an opening along a side thereon for allowing the rectangular second mating port to extend therethrough.

13. The electrical connector as claimed in claim 12 wherein said columnar first mating port is essentially of a columnar body with the corresponding first contacting sections around a center and on a peripheral surface thereof, and the rectangular second mating port is essentially of a rectangular body unitarily formed on the peripheral surface under condition that the second contacting sections are exposed outwardly upon exterior surface of said rectangular body.

14. The electrical connector as claimed in claim 13, wherein both said first contacting sections and said second contacting sections are stiff during mating with the complementary connector.

15. The electrical connector as claimed in claim 14, wherein said connector is linked to a cable at a distal end thereof.

* * * * *